US006824840B2

(12) United States Patent
Miknevich, Jr.

(10) Patent No.: US 6,824,840 B2
(45) Date of Patent: Nov. 30, 2004

(54) INK JET PRINTING PAPER AND METHODS FOR PRODUCING AND USING THE SAME

(75) Inventor: Joseph P. Miknevich, Jr., Coraopolis, PA (US)

(73) Assignee: Nalco Company, Naperville, IL (US)

( * ) Notice: Subject to any disclaimer, the term of this patent is extended or adjusted under 35 U.S.C. 154(b) by 49 days.

(21) Appl. No.: 10/406,165

(22) Filed: Apr. 3, 2003

(65) Prior Publication Data

US 2003/0180481 A1 Sep. 25, 2003

Related U.S. Application Data

(63) Continuation of application No. 09/741,565, filed on Dec. 18, 2000, now abandoned.

(51) Int. Cl.[7] ..... B41M 5/40

(52) U.S. Cl. ..... 428/32.21; 428/32.23; 427/391

(58) Field of Search ..... 428/32.21, 32.23; 427/391

(56) References Cited

U.S. PATENT DOCUMENTS 4,830,911 A * 5/1989 Kojima et al. ..... 428/342
5,597,858 A * 1/1997 Ramesh et al. ..... 524/458

* cited by examiner

*Primary Examiner*—B. Shewareged
(74) *Attorney, Agent, or Firm*—Michael B. Martin; Thomas M. Breininger

(57) ABSTRACT

Print paper for ink printing and method for producing and using the same is provided. The ink print paper includes a cationic dispersion polymer including nonionic monomers and cationic monomers. The cationic monomers at least include an effective amount of hydrophobic cationic monomers such that the cationic dispersion polymer effectively forms a film layer on a surface of the ink print paper to enhance ink print quality.

17 Claims, No Drawings

INK JET PRINTING PAPER AND METHODS FOR PRODUCING AND USING THE SAME

CROSS REFERENCE TO RELATED APPLICATIONS

This is a continuation of Ser. No. 09/741,565, filed Dec. 18, 2000, abandoned.

BACKGROUND OF THE INVENTION

The present invention generally relates to paper and methods for producing and using the same. More specifically, the present invention relates to improved ink jet print paper and methods for producing and using the same to enhance ink print quality.

Ink jet technology has revolutionized modern printing processes by providing an inexpensive method for yielding high quality color or black and white text and images. Although this technology is applicable to any suitable print paper, the highest quality ink jet printing requires specially coated and treated print paper, due to the operability of the ink jet printers.

In ink jet printing, technologically-advanced spray nozzles are utilized to deposit microscopic droplets of a liquid ink onto the print or printer paper. Higher print qualities are obtained by increasing the number of droplets deposited. On plain printer paper, however, a large portion of the pigmented particles of the ink absorb into the sheet along with the liquid carrier. This result causes poor print density and an overall "muddy" appearance to colored images.

Further, at higher resolutions, the carrier liquid cannot absorb rapidly enough into the printer paper thereby spreading across the surface of the printer paper. The text and graphics can thus appear blurry and uneven. Moreover, a printer paper that is overly wet due to the unabsorbed carrier liquid can be problematic with subsequent printed pages.

To address this problem, high quality ink jet printer papers utilize a "conductive polymer" applied to a silica coating. The silica layer provides a white, smooth surface for printing but more importantly wicks away the carrier liquid, i.e., absorbs the carrier liquid, down into the sheet before it can spread onto the surface of the printer paper. The term "conductive polymer" is a misnomer in the sense that the polymer has no electrostatic charge to dissipate. Rather, the "conductive polymer" is a cationic polymer, which functions as a dye or pigment fixative for adhering the anionic pigment particles onto the printer paper, preferably onto the surface of the printer paper.

However, commonly known and used "conductive polymers" do not effectively form a film layer on the surface of the printer paper. Although known "conductive polymers" act as an ink fixative to minimally enhance print quality, these known "conductive polymers" are poor film formers and thus tend to absorb into the printer paper rather than adhere to its surface. This results in an overall loss in detail, that is, resulting in a "muddy" appearance. In addition, the known "conductive polymers" act as humectants, thereby resulting in undesirable properties, such as, inefficient drying of printer paper, sticking of printer paper within a roll or sheet fed stack, and backmarking from previously printed sheets of printer paper. Examples of known "conductive polymers" include, for example, polyamines and poly (diallyldimethyl ammonium chloride) ("pDADMAC").

A need, therefore exists, to provide print paper, particularly ink jet print paper, having improved print density, sharper print detail, improved depth and vibrancy of color, and better drying properties.

SUMMARY OF THE INVENTION

The present invention relates to improved ink print paper and methods for using and producing the same. In particular, the present invention relates to improved ink jet print paper including a cationic dispersion polymer layer having an effective amount of a hydrophobic cationic monomer component to enhance ink print qualities such as, print density, print detail, depth and vibrancy of color, and drying properties.

To this end, an embodiment of the present invention includes printer paper for an ink printing device which comprises a print medium and a cationic dispersion polymer applied to a surface of the print medium, the cationic dispersion polymer including an amount of nonionic monomers and cationic monomers at least including a hydrophobic cationic monomer having the following formula:

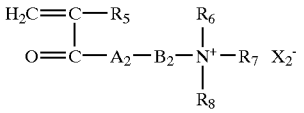

wherein $A_2$ is O or NH; $B_2$ is $C_2$–$C_4$ alkylene or hydroxypropylene; $R_5$ is H or $CH_3$; $R_6$ and $R_8$ are $C_1$–$C_2$ alkyl; $R_7$ is $C_6$–$C_{20}$ alkyl or arylalkyl; and $X_2$ is an anionic counterion.

In another embodiment, the present invention includes a method for producing printer paper which comprises the steps of: providing a print medium having a surface; and applying an amount of a cationic dispersion polymer to the print medium, the cationic dispersion polymer including an amount of nonionic monomers and cationic monomers at least including a hydrophobic cationic monomer having the following formula:

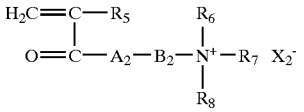

wherein $A_2$ is O or NH; $B_2$ is $C_2$–$C_4$ alkylene or hydroxypropylene; $R_5$ is H or $CH_3$; $R_6$ and $R_8$ are $C_1$–$C_2$ alkyl; $R_7$ is $C_6$–$C_{20}$ alkyl or arylalkyl; and $X_2$ is an anionic counterion.

In yet another embodiment, the present invention includes a method of ink printing which comprises the steps of: providing an ink printing device; providing at least one sheet of printer paper, the printer paper including a cationic dispersion polymer applied to a surface of the printer paper wherein the cationic dispersion polymer includes an amount of nonionic monomers and cationic monomers at least including an amount of hydrophobic cationic monomers having the formula:

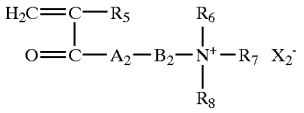

wherein $A_2$ is O or NH, $B_2$ is $C_2$–$C_4$ alkylene or hydroxypropylene, $R_5$ is H or $CH_3$, $R_6$ and $R_8$ are $C_1$–$C_2$ alkyl, $R_7$ is $C_6$–$C_{20}$ alkyl or arylalkyl, and $X_2$ is an anionic counterion; inserting at least one sheet of printer paper into the printing device; and applying ink to the at least one sheet of printer paper.

It is, therefore, an advantage of the present invention to provide printer paper capable of ink printing and methods for producing and using the same.

Yet another advantage of the present invention is to provide printer paper capable of ink jet printing and methods for producing and using the same.

Moreover, an advantage of the present invention is to provide printer paper for ink printing that enhances ink print density, detail, depth, color, and drying properties.

Additional features and advantages of the present invention are described in, and will be apparent in the detailed description of the presently preferred embodiments and from the drawings.

DETAILED DESCRIPTION OF THE PRESENTLY PREFERRED EMBODIMENTS

The present invention relates to improved printer paper for ink printing and methods for using and producing the same. In particular, the present invention relates to improved printer paper for ink jet printing. The printer paper has a film layer of a cationic dispersion polymer applied to a surface of the printer paper. The cationic dispersion polymer includes an amount of nonionic monomers and cationic monomers at least including an effective amount of hydrophobic cationic monomers to enhance ink print quality such as, print density, print detail, depth and vibrancy of color, and drying properties.

As used herein, the following terms shall have the following meanings.

"Alkyl" means a monovalent group derived from a straight or branched chain saturated hydrocarbon by the removal of a single hydrogen atom. Representative alkyl groups include methyl, ethyl, n- and iso-propyl, cetyl, and the like.

"Alkoxy" and "alkoxyl" mean an alkyl-O-group wherein alkyl is defined herein. Representative alkoxy groups include methoxyl, ethoxyl, propoxyl, butoxyl, and the like.

"Alkylene" means a divalent group derived from a straight or branched chain saturated hydrocarbon by the removal of two hydrogen atoms. Representative alkylene groups include methylene, ethylene, propylene, and the like.

"Hydroxypropylene" means a propylene group substituted with hydroxy.

"Aryl" means an aromatic monocyclic or multicyclic ring system of about 6 to about 20 carbon atoms, preferably of about 6 to about 10 carbon atoms. The aryl is optionally substituted with one or more alkyl, alkoxy, halogen or haloalkyl groups. Representative aryl groups include phenyl or naphthyl, or substituted phenyl or substituted naphthyl. A preferred substituent is alkyl.

"Arylalkyl" means an aryl-alkylene-group wherein aryl and alkylene are defined herein. Representative arylalkyl include benzyl, phenylethyl, phenylpropyl, 1-naphthylmethyl, and the like. A preferred arylalkyl is benzyl.

"Halogen" means fluorine, chlorine, bromine or iodine.

"Haloalkyl" means an alkyl group, as defined herein, having one, two, or three halogen atoms attached thereto. Representative haloalkyl groups include chloromethyl, bromoethyl, trifluoromethyl, and the like.

"Anionic counterion" means any organic or inorganic anion which neutralizes the positive charge on the quaternary nitrogen atom of a cationic monomer as defined herein. Representative anionic counterions include halogen, sulfate, phosphate, monohydrogen phosphate, nitrate, and the like. A preferred anionic counterion is halogen.

"Monomer" means a polymerizable allylic, vinylic or acrylic compound. The monomer may be anionic, cationic or nonionic. Vinyl monomers are preferred, acrylic monomers are more preferred.

"Nonionic monomer" means a monomer as defined herein which is electrically neutral. Representative nonionic monomers include acrylamide (AcAm), methacrylamide, N-methylacrylamide, N,N-dimethyl(meth)acrylamide, N-isopropyl(meth)acrylamide, N-(2-hydroxypropyl) methacrylamide, N-methylolacrylamide, N-vinylformamide, N-vinylacetamide, N-vinyl-N-methylacetamide, poly(ethylene glycol)(meth)acrylate, poly (ethylene glycol) monomethyl ether mono(meth)acryate, N-vinyl-2-pyrrolidone, glycerol mono((meth)acrylate), 2-hydroxyethyl(meth)acrylate, vinyl methylsulfone, vinyl acetate, and the like. Preferred nonionic monomers include acrylamide and methacrylamide. Acrylamide is more preferred.

"Hydrophilic cationic monomer" means a monomer as defined herein which possesses a net positive charge and is relatively hydrophilic in nature. Hydrophilic cationic monomers have formula:

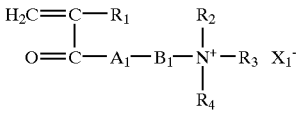

wherein $A_1$ is O or NH; $B_1$ is $C_2$–$C_4$ alkylene or hydroxypropylene; $R_1$ is H or $CH_3$, $R_2$ and $R_4$ are independently $C_1$–$C_2$ alkyl; $R_3$ is H or $C_1$–$C_2$ alkyl; and $X_1$ is an anionic counterion.

Representative hydrophilic cationic monomers include dimethylaminoethylacrylate methyl chloride salt (DMAEA.MCQ), dimethylaminoethylmethacrylate methyl chloride salt (DMAEM.MCQ), dimethylaminoethylmethacrylate methyl sulfate salt (DMAEM.MSQ), dimethylaminoethylacrylate methyl sulfate salt (DMAEA.MSQ), methacrylamidopropyl trimethylammonium chloride (MAPTAC), acrylamidopropyl trimethylammonium chloride (APTAC), and the like. Dimethylaminoethylacrylate methyl chloride salt is preferred.

"Hydrophobic cationic monomer" means a monomer as defined herein which possesses a net positive charge and is relatively hydrophobic in nature. Hydrophobic cationic monomers have the formula:

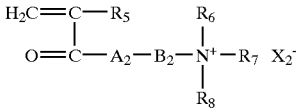

wherein $A_2$ is O or NH; $B_2$ is $C_2$–$C_4$ alkylene or hydroxypropylene; $R_5$ is H or $CH_3$; $R_6$ and $R_8$ are $C_1$–$C_2$ alkyl; $R_7$ is $C_6$–$C_{20}$ alkyl or arylalkyl; and $X_2$ is an anionic counterion. Representative hydrophobic cationic monomers include dimethylaminoethylmethacrylate benzyl chloride salt (DMAEM.BCQ), dimethylaminoethylacrylate benzyl chloride salt (DMAEA.BCQ), dimethylaminoethylacrylate cetyl chloride salt, and the like. Dimethylaminoethylacrylate benzyl chloride salt is preferred.

"Dispersion polymer" means a fine dispersion of a water-soluble polymer in an aqueous continuous phase containing one or more inorganic salts and one or more particle stabilizing polymers. Representative examples of dispersion polymerization of water-soluble polymers in an aqueous continuous phase are found in U.S. Pat. Nos. 4,929,655; 5,006,590; 5,597,859; 5,597,858; and European patent nos. 630,909 and 657,478.

Particle stabilizing polymers, also referred to as stabilizers or dispersants, facilitate the formation of fine particles and keep the formed polymer particles from becoming agglomerated and forming a gel rather than a fine dispersion of particles. Suitable particle stabilizing polymers include water-soluble cationic polymers that are soluble in the initial reaction mixture.

Representative particle stabilizing polymers include homopolymers of cationic N,N-disubstituted-aminoethyl (meth)acrylate monomers and their quaternary salts, and cationic polymers comprising 20 mole percent or more of cationic N,N-disubstituted-aminoethyl(meth)acrylate monomers and their quaternary salts and one or more nonionic monomers, preferably acrylamide, methacrylamide or styrene. The molecular weight of the stabilizer is preferably in the range of about 10,000 to 10,000,000. Preferred particle stabilizing polymers include homopolymers of diallyldimethyl ammonium chloride, dimethylaminoethylacrylate methyl chloride quaternary salt and dimethylaminoethylmethacrylate methyl chloride quaternary salt. The particle stabilizing polymer(s) are used in an amount of from about 1 to about 10% by weight based on the total weight of the dispersion polymer.

Polyvalent anionic salts suitable for preparing the dispersion polymer include inorganic or organic sulfates, phosphates, chlorides or a mixture thereof. Preferred anionic salts include ammonium sulfate, sodium sulfate, magnesium sulfate, aluminum sulfate, ammonium hydrogen phosphate, sodium hydrogen phosphate, potassium hydrogen phosphate and ammonium chloride. The salts are used in aqueous solution typically having a combined total concentration of 15 weight percent or above in the product mixture.

The cationic dispersion polymer of this invention is prepared by preparing a mixture of water, one or more polyvalent anionic salts, nonionic monomers, hydrophilic cationic monomers, hydrophobic cationic monomers, one or more particle stabilizing polymers, any polymerization additives such as chelants, pH buffers or chain transfer agents and charging the mixture to a reactor equipped with a mixer, a temperature regulating thermocouple, a nitrogen purging tube, and a water condenser.

A batch or semi-batch polymerization method can be employed to prepare the dispersion polymer of this invention. In a batch polymerization, the polymeric stabilizers, chain transfer agents, monomers, chelant, and water are initially added to the reactor. All or a portion of the formulation salt/salts are also added to the reactor at this time. Mechanical agitation is started and the reactor contents are heated to the desired polymerization temperature. When the set-point temperature is reached, the initiator is added and a nitrogen purge is started. The reaction is allowed to proceed at the desired temperature until completion and then the contents of the reactor are cooled. Additional inorganic salts may be added during the polymerization to maintain processability or influence final product quality. Moreover, additional initiator may be added during the reaction to achieve desired conversion rates and facilitate reaction completeness. Post polymerization additives such as additional salt, water, stabilizers for molecular weight and pH and anti-foaming and biocidal agents may also be added to the reaction mixture.

Use of a semi-batch polymerization method will vary from a batch polymerization method only in that one or more of the monomers used in the synthesis of the polymer are held out in part or whole at the beginning of the reaction. The withheld monomer is then added over the course of the polymerization. If acrylamide monomer is used as a semi-batch monomer, a chelant is often also added during the semi-batch period.

A multifunctional alcohol such as glycerin or polyethylene glycol may also be included in the polymerization system. The deposition of the fine particles is smoothly carried out in the presence of these alcohols. A chain transfer agent such as sodium formate may also be added to control precipitation and polymer molecular weight.

The polymerization reaction is initiated by any means that results in generation of a suitable free-radical. Thermally derived radicals, in which the radical species results from thermal, homolytic dissociation of a water-soluble azo, peroxide, hydroperoxide and perester compound are preferred. Especially preferred initiators are azo compounds including 2,2'-azobis[2-(2-imidazolin-2yl)propane] dihydrochloride and 2,2'-azobis(2-methylpropionamide) dihydrochloride.

A seed polymer may be added to the reaction mixture before the initiating polymerization of the monomers for the purpose of obtaining a fine dispersion. The seed polymer is a water-soluble cationic polymer that is insoluble or has reduced solubility in the aqueous solution of the polyvalent anion salt. The monomer composition of the seed polymer need not be identical to that of the water-soluble cationic polymer formed during polymerization. The seed polymer is preferably a polymer prepared from the above monomer mixture by the process described herein.

Since the dispersion polymers do not contain surfactants or oil, the dispersion polymers are environmentally friendly. Moreover, the absence of oil in the dispersion polymers equates to such polymers having virtually zero volatile organic content (VOC), which is another environmental advantage of such polymers.

The cationic dispersion polymers of this invention also offer advantages over solution polymer products. In general, solution polymerization is used to prepare lower molecular weight polymers, as the solution tends to become too viscous as the polymer molecular weight increases. Polymer actives concentration are also significantly restricted by the resulting high product viscosity in solution polymer products. Use of dispersion polymerization techniques as described herein allow for the preparation of free-flowing high molecular weight, high polymer actives polymer compositions whereas the corresponding solution polymer would otherwise be too viscous for use without prior dilution.

"Reduced Specific Viscosity" (RSV) is an indication of polymer chain length and average molecular weight. The RSV is measured at a given polymer concentration and temperature and calculated as follows:

$$RSV = \frac{\left[\left(\frac{\eta}{\eta_o}\right) - 1\right]}{c}$$

wherein $\eta$=viscosity of polymer solution;

$\eta_o$ =viscosity of solvent at the same temperature; and c=concentration of polymer in solution.

As used herein, the units of concentration "c" are (grams/100 ml or g/deciliter). Therefore, the units of RSV are dl/g. The RSV is measured at 30° C. The viscosities $\eta$ and $\eta_o$ are measured using a Cannon-Ubbelohde semimicro dilution viscometer, size 75. The viscometer is mounted in a perfectly vertical position in a constant temperature bath adjusted to 30±0.02° C. The error inherent in the calculation of RSV is about 2 dl/g. For the RSV measurements reported herein, the polymer concentration used is 0.045% polymer actives dissolved in a 0.125N ammonium nitrate solution.

Similar RSVs measured for two linear polymers of identical or very similar composition is one indication that the polymers have similar molecular weights, provided that the polymer samples are treated identically and that the RSVs are measured under identical conditions. Preferred cationic dispersion polymers of this invention have a RSV of at least about 10, measured at a polymer concentration of 0.045% polymer actives in 0.125N ammonium nitrate solution.

In an embodiment, a printer paper for a printing device includes a print medium and a cationic dispersion polymer applied to a surface of the print medium wherein the cationic dispersion polymer includes an amount of nonionic monomers and cationic monomers at least including a hydrophobic cationic monomer having the following formula:

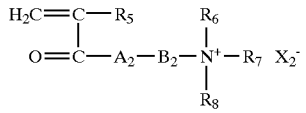

wherein $A_2$ is O or NH; $B_2$ is $C_2$–$C_4$ alkylene or hydroxypropylene; $R_5$ is H or $CH_3$; $R_6$ and $R_8$ are $C_1$–$C_2$ alkyl; $R_7$ is $C_6$–$C_{20}$ alkyl or arylalkyl; and $X_2$ is an anionic counterion.

The cationic monomers can further include an amount of monomers having the following formula:

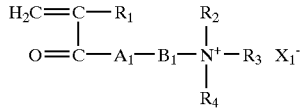

wherein $A_1$ is O or NH; $B_1$ is $C_2$–$C_4$ alkylene or hydroxypropylene; $R_1$ is H or $CH_3$, $R_2$ and $R_4$ are independently $C_1$–$C_2$ alkyl; $R_3$ is H or $C_1$–$C_2$ alkyl; and $X_1$ is an anionic counterion.

The inventors of the present invention have advantageously discovered that the amount of the hydrophobic cationic monomer desirably effects the film forming capabilities of the cationic dispersion polymer. As the amount of hydrophobic cationic monomer is increased, the film forming capabilities of the cationic dispersion polymer are enhanced. The enhanced film forming properties desirably effect the ink printing quality of the printer paper of the present invention. It is suggested that the cationic dispersion polymer film layer desirably acts to "wick away" the ink carrier fluid down into the print paper to provide a crisper and more uniform ink print on the printer paper.

In an embodiment, the cationic dispersion polymer includes up to about 80 mole percent of cationic monomers including up to about 50 mole percent of hydrophobic cationic monomers. In an embodiment, the hydrophobic cationic preferably includes about 50 mole percent of hydrophobic cationic monomers. In a preferred embodiment, the cationic dispersion polymer is a 50/30/20 mole percent dimethylaminoethylacrylate benzyl chloride salt/dimethylaminoethylacrylate methyl chloride salt/acrylamide terpolymer as discussed below.

In another embodiment, the present invention provides a method for producing ink printer paper. The method includes providing a print medium having a surface; and applying an amount of a cationic dispersion polymer to the print medium. The cationic dispersion polymer includes an amount of nonionic monomers and cationic monomers at least including a hydrophobic cationic monomer having the following formula:

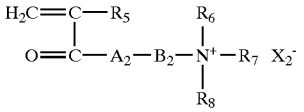

wherein $A_2$ is O or NH; $B_2$ is $C_2$–$C_4$ alkylene or hydroxypropylene; $R_5$ is H or $CH_3$; $R_6$ and $R_8$ are $C_1$–$C_2$ alkyl; $R_7$ is $C_6$–$C_{20}$ alkyl or arylalkyl; and $X_2$ is an anionic counterion.

As previously discussed, an advantage of the print paper of the present invention is the film forming capabilities of the cationic dispersion polymer. The present invention is not limited by the thickness of the film layer and can include any suitable thickness so as to effectively act to "wick away" the ink carrier fluid as discussed above. In an embodiment, the cationic dispersion polymer is applied to the print paper in an amount of at least 0.2 lb/3000 $ft^2$. In an embodiment, the present invention provides applying to the print paper a solution containing the cationic dispersion polymer in an amount of at least one percent based on volume percent of the solution.

It should be appreciated that the present invention is not limited to the type of print medium and can include any suitable print medium used in ink printing, preferably ink jet printing applications.

In another embodiment, the present invention provides a method of ink printing which includes the steps of providing an ink printing device; providing at least one sheet of printer paper. The printer paper includes a cationic dispersion polymer applied to a surface of the printer paper wherein the cationic dispersion polymer includes an amount of nonionic monomers and up to about 80 mole percent of cationic monomers at least including an amount of hydrophobic cationic monomers having the formula:

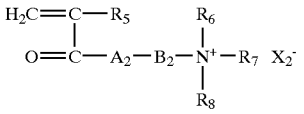

wherein $A_2$ is O or NH; $B_2$ is $C_2$–$C_4$ alkylene or hydroxypropylene; $R_5$ is H or $CH_3$; $R_6$ and $R_8$ are $C_1$–$C_2$ alkyl; $R_7$ is $C_6$–$C_{20}$ alkyl or arylalkyl; and $X_2$ is an anionic counterion.

The ink print paper of the present invention can be utilized with any suitable ink printing device, preferably any suitable ink jet printing device. The ink print paper can be utilized to produce both color and black and white text and images.

EXAMPLE

The ink print paper of the present invention was prepared on a laboratory scale. A solution containing the cationic dispersion polymer in one percent based on volume percent of the solution was prepared. The cationic dispersion polymer is a 50/30/20 mole percent dimethylaminoethylacrylate benzyl chloride salt/dimethylaminoethylacrylate methyl chloride salt/acrylamide terpolymer having a RSV of from about 10 to about 22, measured at a polymer concentration of 0.045% polymer actives in 0.125N ammonium nitrate solution. This cationic dispersion polymer is commercially available from Nalco Chemical Company, Naperville, Ill. The solution was applied in amounts varying from 0.2 lb/3000 $ft^2$ to 0.3 lb/3000 $ft^2$ to a number of different printer papers using a wire wound meyer rod, namely #3, #6 and

#10. The printer paper was dried and allowed to condition at ambient humidity. Comparative tests were conducted on ink printing performance of the printer paper coated with the cationic dispersion polymer, printer paper with no polymer (i.e., no treatment), and printer paper coated with pDADMAC. Commercially available ink jet printing devices (Hewlett Packard CSE printer, Epson Stylus 600 printer) devices were utilized to perform the comparative tests.

Test Results

In each test, the printer paper with the cationic dispersion polymer outperformed the printer paper without treatment and the printer paper with pDADMAC. The ink print quality of the printer paper with the cationic dispersion polymer exhibited far superior ink print qualities, such as brighter colors, denser black print, and quicker drying properties with good wet rub resistance, than the other print papers (i.e., uncoated and coated with pDADMAC).

In particular, printer paper coated with the cationic dispersion polymer in an amount of 0.3 lb/3000 $ft^2$ exhibited enhanced ink print quality of a two dimensional image and text as compared to printer paper with no polymer coating.

Printer paper coated with the cationic dispersion polymer in an amount of 0.2 lb/3000 $ft^2$ exhibited desirable ink print quality of a three dimensional image as compared to printer paper having no polymer coating.

It should be understood that various changes and modifications to the presently preferred embodiments described therein will be apparent to those skilled in the art. Such changes and modifications can be made without departing from the sphere and scope of the present invention and without diminishing its intended advantages. It is therefore intended that all such changes and modifications be covered by the intended claims.

What is claimed is:

1. Printer paper for an ink printing device, comprising:

paper and a cationic dispersion polymer applied to a surface of the paper, the cationic dispersion polymer including nonionic monomers and cationic monomers at least including a hydrophobic cationic monomer having the following formula:

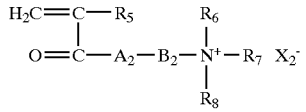

wherein $A_2$ is O or NH; $B_2$ is $C_2$–$C_4$ alkylene or hydroxypropylene; $R_5$ is H or $CH_3$; $R_6$ and $R_8$ are $C_1$–$C_2$ alkyl; $R_7$ is $C_6$–$C_{20}$ alkyl or arylalkyl; and $X_2$ is an anionic counterion.

2. The printer paper of claim 1 wherein the cationic monomers further include monomers having the following formula:

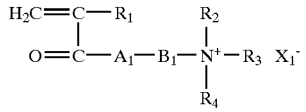

wherein $A_1$ is O or NH; $B_1$ is $C_2$–$C_4$ alkylene or hydroxypropylene; $R_1$ is H or $CH_3$, $R_2$ and $R_4$ are independently $C_1$–$C_2$ alkyl; $R_3$ is H or $C_1$–$C_2$ alkyl; and $X_1$ is an anionic counterion.

3. The printer paper of claim 1 wherein the cationic dispersion polymer includes up to about 80 mole percent of cationic monomers.

4. The printer paper of claim 1 wherein the cationic dispersion polymer includes up to about 50 mole percent of hydrophobic cationic monomers.

5. The printer paper of claim 1 wherein the cationic dispersion polymer includes about 50 mole percent of hydrophobic cationic monomers.

6. The printer paper of claim 1 wherein the cationic dispersion polymer is a 50/30/20 mole percent dimethylaminoethylacrylate benzyl chloride salt/dimethylaminoethylacrylate methyl chloride salt/acrylamide terpolymer.

7. The printer paper of claim 1 wherein the hydrophobic cationic monomer is dimethylaminoethylacrylate benzyl chloride.

8. A method for producing the ink jet printer paper of claim 1, comprising the steps of:

providing paper having a surface; and applying an amount of a cationic dispersion polymer to the paper, the cationic dispersion polymer including an amount of nonionic monomers and cationic monomers at least including a hydrophobic cationic monomer having the following formula:

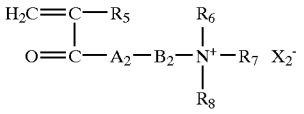

wherein $A_2$ is O or NH; $B_2$ is $C_2$–$C_4$ alkylene or hydroxypropylene; $R_5$ is H or $CH_3$; $R_6$ and $R_8$ are $C_1$–$C_2$ alkyl; $R_7$ is $C_6$–$C_{20}$ alkyl or arylalkyl; and $X_2$ is an anionic counterion.

9. The method of claim 8 wherein the cationic dispersion polymer includes up to about 80 mole percent of cationic monomers at least including up to about 50 mole percent of hydrophobic cationic monomers.

10. The method of claim 8 wherein the cationic monomers further includes about 50 mole percent of the hydrophobic cationic monomers.

11. The method of claim 8 wherein the cationic dispersion polymer is applied to the print medium in an amount of at least about 0.2 lb/3000 $ft^2$.

12. The method of claim 8 wherein the cationic dispersion polymer is applied as a solution containing at least one percent of cationic dispersion polymer based on volume.

13. The method of claim 8 further comprising the step of forming a film layer of the cationic dispersion polymer on the surface of the print medium.

14. Printer paper for an ink printing device, comprising:

paper and a cationic dispersion polymer applied to a surface of the paper, the cationic dispersion polymer including nonionic monomers and up to about 80 mole percent of cationic monomers at least including a hydrophobic cationic monomer having the following formula:

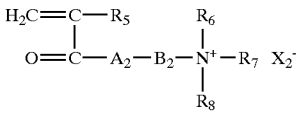

wherein $A_2$ is O or NH; $B_2$ is $C_2$–$C_4$ alkylene or hydroxypropylene; $R_5$ is H or $CH_3$; $R_6$ and $R_8$ are $C_1$–$C_2$ alkyl; $R_7$ is $C_6$–$C_{20}$ alkyl or arylalkyl; and $X_2$ is an anionic counterion and a hydrophilic cationic monomer having the following formula:

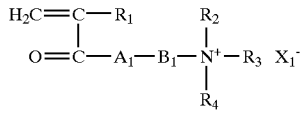

wherein $A_1$ is O or NH; $B_1$ is $C_2$–$C_4$ alkylene or hydroxypropylene; $R_1$ is H or $CH_3$; $R_2$ and $R_4$ are independently $C_1$–$C_2$ alkyl; $R_3$ is H or $C_1$–$C_2$ alkyl or arylalkyl; and $X_1$ is an anionic counterion.

15. The printer paper of claim 14 wherein the cationic dispersion polymer includes up to about 50 mole percent of hydrophobic cationic monomers.

16. The printer paper of claim 14 wherein the cationic dispersion polymer includes about 50 mole percent of hydrophobic cationic monomers.

17. The printer paper of claim 14 wherein the cationic dispersion polymer is a 50/30/20 mole percent dimethylaminoethylacrylate benzyl chloride salt/dimethylaminoethylacrylate methyl chloride salt/acrylamide terpolymer.

* * * * *